US008951045B1

(12) United States Patent
White

(10) Patent No.: US 8,951,045 B1
(45) Date of Patent: Feb. 10, 2015

(54) TOOTHBRUSH BRISTLE ARRANGEMENT AND METHOD

(71) Applicant: Dennis J. White, Plainsboro, NJ (US)

(72) Inventor: Dennis J. White, Plainsboro, NJ (US)

( * ) Notice: Subject to any disclaimer, the term of this patent is extended or adjusted under 35 U.S.C. 154(b) by 0 days.

(21) Appl. No.: 14/146,632

(22) Filed: Jan. 2, 2014

Related U.S. Application Data

(60) Provisional application No. 61/848,373, filed on Jan. 2, 2013.

(51) Int. Cl.
*A46B 9/04* (2006.01)
*A61C 15/00* (2006.01)
*A46B 9/02* (2006.01)

(52) U.S. Cl.
CPC ..... *A46B 9/02* (2013.01)
USPC ..... 433/216; 15/167.1

(58) Field of Classification Search
USPC ..... 15/167.1, 207.2; D4/104, 106; 433/216
See application file for complete search history.

(56) References Cited

U.S. PATENT DOCUMENTS

| | | | | | |
|---|---|---|---|---|---|
| 2,004,633 | A * | 6/1935 | Miller | 15/167.1 |
| 2,242,743 | A * | 5/1941 | Brown | 15/167.1 |
| 3,085,273 | A * | 4/1963 | Cowan | 15/167.1 |
| 3,731,336 | A * | 5/1973 | Rubin | 15/167.1 |
| D243,568 | S * | 3/1977 | Axelsson | D4/104 |
| 6,823,554 | B1 * | 11/2004 | Braun et al. | 15/167.2 |
| 7,360,270 | B2 * | 4/2008 | Moskovich et al. | 15/28 |

* cited by examiner

*Primary Examiner* — Randall Chin
(74) *Attorney, Agent, or Firm* — Dorothy S. Morse

(57) ABSTRACT

A toothbrush having multiple bundles of bristles preferably arranged in two rows spaced apart from one another, and each bundle independently anchored into the front surface of the brush head with bundles in the opposed rows directed inwardly toward one another and angled toward a common intersection, allowing the free tip ends of the bristles to terminate in a single, common row. Each bundle is free standing and the bundles in one row have alternating relation with the bundles in the other row or rows. Thus, the free tip ends of the bristles in each bundle terminate independently and unopposed, allowing the bristles in each bundle to have movement independent from those in adjacent bundles, apply less force against teeth, and provide less abrasion of the rounded outward tooth surfaces at or near the gingival level during the cleaning of interproximal areas of teeth.

11 Claims, 2 Drawing Sheets

TOOTHBRUSH BRISTLE ARRANGEMENT AND METHOD

CROSS-REFERENCES TO RELATED APPLICATIONS

This patent application relates to U.S. provisional patent application 61/848,373 filed by the same inventor on Jan. 2, 2013, which discloses substantially the same subject matter therein and has the title of Toothbrush Bristle Arrangement. Thus, the applicant/inventor herein respectfully requests that domestic priority herein be granted based upon his earlier filed U.S. provisional patent application 61/848,373 described above.

BACKGROUND

1. Field of the Invention

This invention is in the field of toothbrushes used for the care and cleaning of teeth and gums, particularly to a toothbrush having a bristle arrangement comprising at least two rows of bristles grouped in bundles, each independently anchored into a base (also referred to herein by the term toothbrush "head"). Although two rows of bundled bristles are most preferred in the present invention, it is considered within the scope of the present invention to have more than two rows of bundled bristles. Thus, for convenience and language efficiency in the disclosure herein, embodiments with two rows of bundled bristles will most commonly be discussed, without any intent of limitation.

The bundles of bristles in each row of the present invention are directed inwardly toward the other row and positioned at an angle of common intersection, such that substantially all of the free tip ends of the bristles terminate in a single, common row. Although not critical, the common row is most often longitudinal, and centered laterally on the toothbrush head, as shown in the accompanying illustrations. In addition, the bundles of bristles in each row are preferably soft, and anchored in alternating relation to the bundles of bristles in the opposing row. Thus, the free tip ends of each bundle of bristles are unopposed and terminate independently to become part of the single, common row of bristles. Also, the tip ends in each bundle of bristles remain free standing, allowing each bristle to have movement independent of the bristles in the next adjacent bundle or bundles. As a result, and importantly, it is this independent arrangement of inwardly directed bundles of bristles positioned in alternating relation to the bundles in the opposing row that makes each bundle of bristles free standing, enabling a different angle of attack for the bristles therein relative to the movement of bristles in adjacent bundles, resulting in less tooth abrasion during use when compared to the toothbrushes commonly used today.

2. Description of the Related Art

Today's toothbrushes comprise a collection of many bundles of bristles, each bundle separated from the others in the brush base holder, each bundle having a column-shaped configuration, and each bundle aligned in rows with neighboring bundles. Although such toothbrushes serve well and are commonly used, an important disadvantage to their use is abrasion of the rounded outward facing part of the tooth structure, particularly the rounded part at or near the gingival level. With regard to the aging process of human teeth, if people live long enough they will eventually experience recession of the gum and notching of teeth at the gum line. The notches are not decay, but are treated as such and filled with a composite resin restoration. Notching is a common occurrence in elderly patients, and treated by dentists on a daily basis. If untreated, the notches progress, and may eventually advance down to the tooth's nerve. During their teeth cleaning use, toothbrush bristles tend to hit the closest thing to them, when, in fact, it is more important for people to target the area between the teeth during cleanings. Thus, the part of the tooth facing most outward from the mouth is typically cleaned first by toothbrush bristles, before the bristles are pressed further into the interproximal areas. As a result, the curved outward facing part of teeth will bear the force of the toothbrush bristles twice, initially and also during the cleaning of interproximal areas. Thus, over time tooth brushing wears down the outward facing tooth structure. When the bristles are pressed further into the interproximal areas, the aligned bundles of bristles in today's toothbrushes serve detrimentally as they become compressed against the outward facing tooth surface, and the bundles each act as a column, with added force being applied against the rounded/curved outward part of the teeth to overcome the strength of the column and splay the bristle tip ends to direct them around the teeth and into the deeper interproximal areas. Thus, when considering the detrimental abrasion it causes to the rounded/curved and outward facing part of the tooth structure, today's toothbrushes can be said to have an inefficient design, leaving much room for improvement.

In contrast to the known prior art, the bundles of bristles in each row of a present invention toothbrush are anchored in alternating relation to the bundles of bristles in the opposing row. Thus, the free tip ends of each bundle of bristles in a present invention toothbrush remains free standing, allowing each bristle to have movement independent of the bristles in the next adjacent bundle or bundles. As a result, and importantly, the free standing positioning of each present invention bundle of bristles enables a different angle of attack for the bristles therein relative to the movement of bristles in adjacent bundles, resulting in less force being applied to tooth surfaces and less tooth abrasion to the rounded/curved and outward facing part of the tooth, particularly at or near the gingival level. While other dental brushes are known to include angulations of bristles to a single common free end, all are in a linier arrangement and poise the free tip ends of one group of angled bristles directly into those of an opposing group. This convergence of bristles from the opposed rows at a single point creates the important disadvantage of causing more wear on the rounded outward facing tooth surfaces when the cleaning of difficult-to-reach interproximal areas is attempted, since all bristles in a bundle then behave as a unit, dampening the full function of each individual angled bundle of bristles and applying more force to the closest tooth surfaces. As a result during teeth cleaning with prior art dental brushes having opposed groups of bristles, teeth become notched at the gum line an accelerated rate when compared to teeth cleaning conducted with the present invention toothbrush. No prior art dental brush intended for the general cleaning of tooth surfaces, as well as interproximal areas, is known to provide alternating groups of bundled bristles having substantially all their bristle tip ends directed inwardly and positioned at an angle of common intersection for termination in a single common row, as found in the present invention, which has been observed by the inventor herein during its development to reduce wear on the rounded outward facing tooth surfaces, particularly at or near the gum line.

BRIEF SUMMARY OF THE INVENTION

The primary objective of the present invention is to provide a toothbrush that is usable for cleaning all tooth surfaces, including interproximal areas, while applying less force against teeth and gums during tooth cleaning to reduce wear and deterioration of tooth surfaces, as well as gum recession. It is also an objective of this invention to provide a toothbrush that creates less abrasion of the rounded outward tooth surfaces at or near the gingival level during the cleaning of interproximal areas of teeth to reduce notching of teeth at the gum line. It is a further objective of this invention to provide a toothbrush having multiple bundles of bristles arranged in at least two spaced-apart rows, with all bundles directed inwardly and positioned at an angle of common intersection that allows the free tip ends of the bristles to terminate in a single, common row. A further objective of this invention is to provide a toothbrush wherein each bundle is free standing and the free tip ends of the bristles in each bundle are unopposed by bristles in any other bundle, thus allowing the bristles in each bundle to have independent movement. Another objective of this invention is to provide a toothbrush and method that can be used to clean and massage gingival tissue, maximizing oral health. It is also an objective of this invention to provide a toothbrush and method of use through which the toothbrush may be used with two hands to clean the interproximal areas of teeth, wherein one hand holds the free tip ends of bristles in contact with adjacent teeth surfaces, while the other hand causes an agitation of the bristles with a quick vibratory motion. It is yet another objective of this invention to provide a toothbrush with sturdy and durable construction for repeat use. It is a further objective of this invention to provide a toothbrush with a handle having thickness and length dimensions that allow easy and comfortable manipulation by a user's hand, particularly during the bristle agitation step used to clean interproximal areas of teeth.

The most preferred embodiment of the present invention toothbrush comprises an elongated handle with opposed ends and a head depending from one of those ends, with the head having bundles of bristles anchored therein and forming two spaced-apart, longitudinally extending rows. The free standing bundles in each row are anchored in alternating relation to those in the opposing row. The bristles in all bundles are also positioned at an angle of common intersection with their tip ends forming a single, centrally-located common row. Thus, each bristle has movement independent from the bristles in the next adjacent bundle or bundles, enabling a different angle of attack for the bristles in one bundle relative to the movement of bristles in adjacent bundles, resulting in less force being applied to tooth surfaces and less tooth abrasion, particularly against rounded outer facing tooth surfaces and tooth surfaces near the gum line. In contrast, if bundles were positioned directly opposed to those in the opposing row in a linier arrangement, the convergence of all bristles from the opposing rows at a single point would cause them to behave as a unit and create the more wear on rounded outer tooth surfaces when used to clean the difficult-to-reach interproximal areas. The present invention toothbrush can be used in the traditional way to clean the easily-reached and outward facing surfaces of teeth. However, during the cleaning of interproximal areas between adjacent teeth, the free tip ends of the bristles are preferably held in full contact with the teeth in an orientation substantially perpendicular to the long axis of the tooth, and the brush head is agitated with a one-handed or two-handed action. Although not critical, it is intended for the present invention toothbrush to be held in a generally horizontal orientation relative to teeth so that cleaning of multiple interproximal areas can occur during each agitation step. During two-handed use, the user may hold the bristles in place with one hand, while the other hand (preferably the predominant hand) agitates the bristles with a quick vibratory motion.

DETAILED DESCRIPTION OF THE INVENTION

Figure 1:
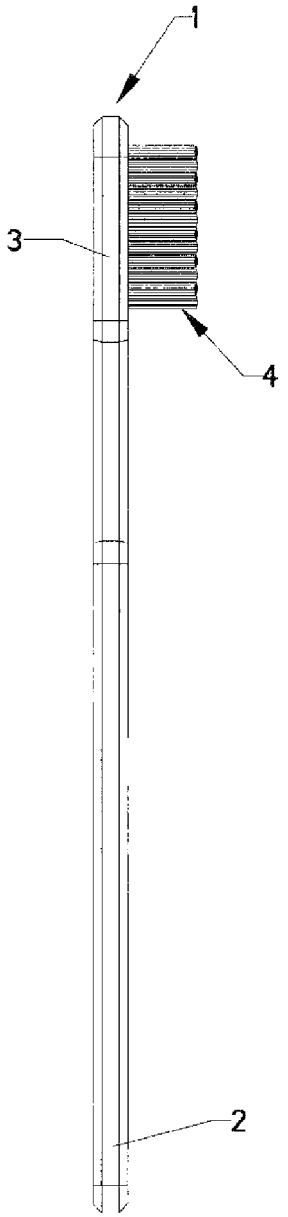
FIG. 1 is a left side view of the most preferred embodiment of the present invention toothbrush having bundles of bristles arranged in two rows longitudinally in the front of the brush head, with the base portions of the bundles in each row anchored in alternating relation to those of the bundles of bristles in the opposing row, so that when viewed from the side substantially all of each bundle is visible, whether anchored in the near row or the remote row, the free tip ends of the bristles in the bundles anchored in the remote row darkened as a result of its angled positioning, and further with the bristles in each row directed inwardly toward the other row and positioned at an angle of common intersection, such that substantially all of the free tip ends of the bristles terminate in a single, centrally-positioned common row that allows the bristles in each bundle to remain free standing and each bristle to have movement independent of the bristles in the next adjacent bundle or bundles within the common row.

The present invention toothbrush 1 has been created to reduce gum recession and notching of teeth during the important cleaning of interproximal areas of teeth that is preferred at least minimally on a daily basis for good oral health. Attached to its elongated handle 2 is a head 3 having bundles of bristles 4 positioned in at least two spaced-apart longitudinal rows. The free standing bundles of bristles 4 in each row are directed inwardly toward the opposed row or rows and positioned at an angle of common intersection, such that substantially all free tip ends 6 of the bristles 4 terminate in a single, common row 5. However no bundle of bristles 4 is positioned in direct opposition to any other bundle of bristles 4. This allows each bristle 4 to have movement independent of the bristles 4 in the next adjacent bundle or bundles within the common row 5, enabling a different angle of attack for the bristles 4 in one bundle relative to the movement of bristles 4 in adjacent bundles, resulting in less force being applied to tooth surfaces and less tooth abrasion, particularly when the cleaning of interproximal areas occurs. In contrast, if bundles of bristles 4 were positioned directly opposite to those in the opposing row or rows in a linier arrangement, the convergence of all bristles 4 from opposing rows at a single point would cause them to behave as a unit and create the more wear on tooth surfaces, particularly when the cleaning of difficult-to-reach interproximal areas is attempted. FIGS. 1-5 show various views of the head 3, handle 2, and preferred positioning of the bundles of bristles 4 in the most preferred embodiment of the present invention toothbrush 1.

Figure 2:
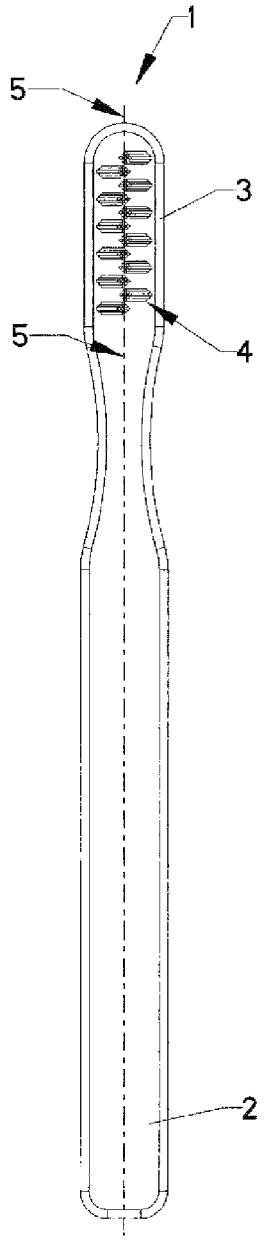
FIG. 2 is a front view of the toothbrush in FIG. 1 showing the bundles of bristles anchored in two spaced-apart rows longitudinally on the front of the brush head with all bristle tip ends terminating in a single, common row, and the anchored ends of the bundled bristles in each row anchored in alternating relation to those of the bundled bristles in the opposing row, allowing each bristle to have movement uninhibited by any bristle in the opposing row.
Figure 3:
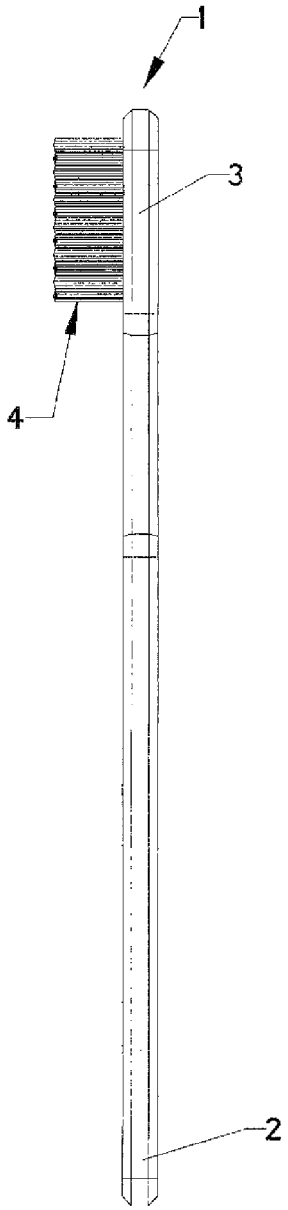
FIG. 3 is a right side view of the toothbrush in FIGS. 1 and 2 and together with FIG. 1 showing the back and side surfaces of the brush head and handle unadorned, and the free tip ends of the bristles in the bundles anchored in the remote row darkened as a result of its angled positioning.

FIG. 1 is a left side view of the most preferred embodiment of the present invention toothbrush 1 having bundles of bristles 4 arranged in two rows longitudinally in the front of the brush head 3, with the anchoring base portion of the bundles of bristles 4 in each row anchored in alternating relation to the bundles of bristles 4 in the opposing row, so that when viewed from the side bristles 4 in each bundle are visible. Also in FIG. 1, the free tip ends 6 of bristles 4 in the remote row of bristles 4 (every other bundle of bristles 4, starting with the topmost bundle of bristles 4) have a darkened appearance to indicate their angled positioning toward an observer which reveals the top surface of the free tip ends 6 of the bundled bristles 4. In contrast, the bundled bristles 4 anchored in the near row of the toothbrush 1 shown in FIG. 1 have angled positioning away from an observer, preventing the top surface of their free tip ends 6 from being visible in FIG. 1. The bristles 4 in each row are also directed inwardly toward the other row and positioned at an angle of common intersection, such that substantially all of the free tip ends 6 of the bristles 4 terminate in a single, common row 5 (see FIG. 2), allowing the bristles 4 in each bundle to remain free standing and each bristle 4 to have movement independent of the bristles 4 in the next adjacent bundle or bundles. Although the thickness and length dimensions of the head 3 and handle 2 shown in FIG. 1 are preferred, they should not be considered as limiting (see FIGS. 4 and 5 for one example of a handle 2 having a shorter length dimension). Furthermore, the length and width dimensions of the bristles 4 are merely exemplary, and should also not be considered as limiting. The number of bundles of bristles 4 may also be different from that shown in FIG. 1 (see FIGS. 4 and 5 for one example of a different number of bundles of bristles 4). In addition, the number of bristles 4 per bundle may be different from that shown in FIG. 1, and the number of bristles 4 per bundle does not have to be uniform in all bundles as long as the free tip ends 6 of substantially all bristles 4 in all rows present terminate in a single, common row 5. Furthermore, although common row 5 is shown in all of the accompanying illustrations with centered positioning on head 2, this is not considered a critical feature. In combination with FIGS. 2 and 3, FIG. 1 shows the side and back surfaces of head 3, as well as the front, side, and back surfaces of handle 2, in an unadorned condition. However, although not shown, surface printing and/or other adornment or color diversity, including textured surface patterns and transparent or translucent material with visible imbedded decorative elements, is considered to be within the scope of the present invention.

FIG. 2 is a front view of the toothbrush 1 in FIG. 1 showing the bundles of bristles 4 anchored in two spaced-apart rows longitudinally extending on the front of the brush head 3 with the free tip ends 6 all bristles 4 terminating in a single, centrally-positioned common row 5, and the anchored ends of the bundled bristles 4 in each row anchored in alternating relation to those of the bundled bristles 4 in the opposing row, allowing each bristle 4 to have movement uninhibited by any bristle 4 in the next adjacent bundle or bundles.

FIG. 3 is a right side view of the toothbrush in FIGS. 1 and 2 and together with FIG. 1 showing the rear and side surfaces of the brush head 3 and handle 2 unadorned, and the free tip ends 6 of the bristles 4 in the bundles anchored in the remote row darkened as a result of its angled positioning toward an observer of the toothbrush 1 in FIG. 3 (every other bundle of bristles 4, moving upward from the bottommost bundle of bristles 4).

Figure 4:
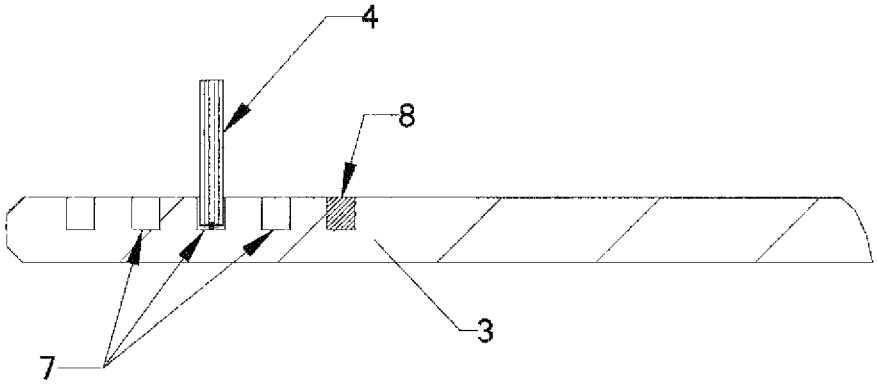
FIG. 4 is a sectional view of bristle placement in preferred embodiments of the present invention that shows five receiving bores created in the toothbrush's head each for anchoring one bundle of bristles and together providing one row of bristles, with FIG. 4 also showing the anchoring end of one bundle of bristles positioned within a receiving bore, and the rightmost bore having angled lines representing adhesive, molded positioning, pressed-fit positioning, over-molding, or other substance, means, or material that helps the anchored ends of the bundled bristles to stay in a fixed position relative to the present invention toothbrush head during tooth cleaning use.

FIG. 4 is a sectional view of bristle placement in preferred embodiments of the present invention that shows five receiving bores 7 created in the toothbrush's head 3 each for anchoring one bundle of bristles 4 and together providing one row of bristles 4, with FIG. 4 also showing the anchoring end of one bundle of bristles 4 positioned within a receiving bore 7, and the rightmost bore 7 having angled lines 8 representing adhesive, molded positioning, pressed-fit positioning, over-molding, or other substance, means, or material that helps the anchored ends of the bundled bristles 4 to stay in a fixed position relative to the present invention toothbrush head 3 during tooth cleaning use.

Figure 5:
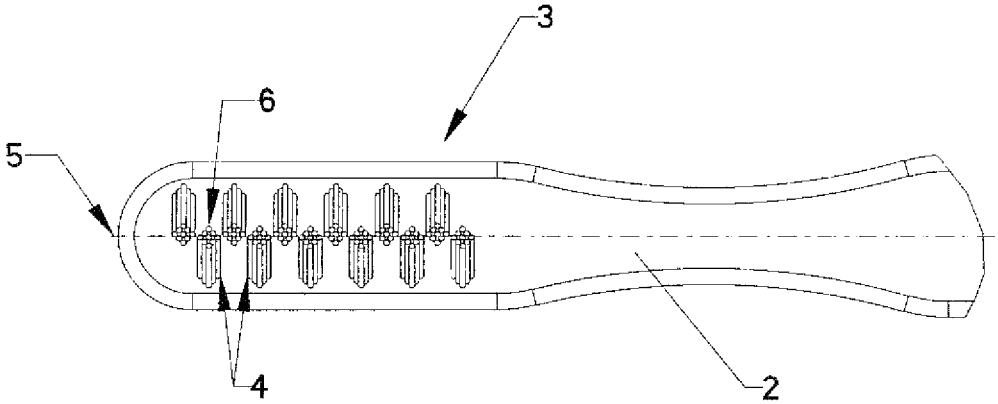
FIG. 5 is an enlarged front view of the toothbrush in FIG. 4 showing bundles of bristles arranged in two rows longitudinally therein, the base of the bundles in each row anchored in alternating relation to the bundles of bristles in the opposing row and the bristles in all bundles directed inwardly toward the other row and positioned at an angle of common intersection, such that substantially all of the free tip ends of the bristles terminate in a single, common row, with the bristles in each bundle also free standing and having movement independent of the bristles in the other row to provide less abrasion of the rounded outward facing tooth surfaces, particularly those at or near the gingival level during the cleaning of interproximal areas of the teeth.

FIG. 5 is an enlarged front view of the present invention toothbrush in FIG. 4 showing bundles of bristles 4 arranged in two rows longitudinally therein, the base of the bundled bristles 4 in each row anchored in alternating relation to the bundles of bristles 4 in the opposing row and the bristles 4 in all bundles having an angled orientation allowing substantially all of the tip ends of all bristles 4 in both rows to terminate in a single, common row 5, with the bristles 4 in each bundle free standing and having movement independent of the bristles 4 in the next adjacent bundle or bundles to provide less abrasion of the rounded outward facing tooth surfaces, particularly those at or near the gingival level during the cleaning of interproximal areas of teeth. Although the common row 5 formed by the free tip ends 6 of bristles 4 is typically centered longitudinally on head 3, this is not critical. The common row 5 of bristles 4 is enlarged and more clearly visible in FIG. 5 than in the previously prevented illustration in FIG. 2. As can be determined by viewing FIGS. 1-3 and 5, the highest elevation of bristles 4 above head 3 is where the tip ends of bristles 4 terminate in the single, common row 5.

The present invention toothbrush 1 can be used in the traditional way (in a generally horizontally extending orientation) to clean the easily reached outward-facing and rearward-facing surfaces of teeth, generally brushing in a downward direction across exposed tooth surfaces. However, during the cleaning of interproximal areas between adjacent teeth and also while in a generally horizontally extending orientation, the common row 5 formed by the free tip ends 6 of bristles 4 is typically positioned across the targeted interproximal areas of several adjacent teeth and agitated with a one-handed or two-handed action. It is important that bristles 4 are directed inwardly toward teeth in an orientation that moves them straight (perpendicular) to the long axis of the tooth structure at or near the tooth-gingival margin, and for this positioning to be maintained during the agitation, whereby teeth are cleaned and gingival tissue is massaged, maximizing oral health. This orientation is different from that commonly used today with prior art toothbrushes, wherein bristles are held against the tooth/gum junction at a 45-degree angle (also known as the Bass technique). During a one-handed agitation of the present invention toothbrush 1, after alignment of common row 5 with the targeted interproximal areas, the user may enwrap a portion of one hand around handle 2 and then cause a quick vibratory motion of toothbrush 1 while placing one or two fingers of the vibrating hand against the back of brush head 3 to maintain the free tip ends 6 of bristles 4 in full contact with the teeth while agitation occurs. During two-handed use, a finger or fingers on one of the user's hands may be used to secure the back of head 3 so as to hold the free tip ends 6 of bristles 4 against the targeted interproximal areas, while the other hand (preferably the user's predominant hand) engages handle 2 and with a quick vibratory motion causes agitation of the free tip ends 6 of bristles 4 again the interproximal areas to clean tooth surfaces therein and/or massage gingival tissue.

I claim:

1. A toothbrush used for cleaning teeth with less abrasion against the exposed outward facing tooth surfaces while the cleaning of interproximal areas between teeth occurs, said toothbrush comprising:

an elongated handle with opposed ends;

a brush head depending from one of said opposed ends of said handle and having front and back surfaces, said front surface having a plurality of receiving holes aligned in at least two spaced-apart rows with said receiving holes in one said row positioned in alternating relation to the receiving holes in the remaining ones of said at least two spaced-apart rows so that none of said receiving holes is directly aligned with any of said receiving holes in the remaining ones of said at least two spaced-apart rows; and a plurality of bristles arranged to form a number of bundles of bristles equal to the number of receiving holes, each said bristle having a free tip end and an anchored end, with said anchored ends of said bristles in each said bundle secured within a different one of said receiving holes that causes said bundle to become free standing, said bundles of bristles in said at least two spaced-apart rows also inwardly directed and angled toward a common intersection allowing substantially all of said free tip ends of said bristles in all said bundles to terminate in a single common row prior to use, with said free tip ends in said common row providing the highest elevation of said bristles above said brush head and said alternating relation of said anchored ends of said bristles in each said bundle also allowing movement of said free tip ends in each said bundle to be independent from movement of said free tip ends of said bristles in adjacent ones of said bundles, wherein when said free tip ends of said bristles in said common row are positioned close to interproximal areas of teeth for cleaning them, prior to said free tip ends of said bristles moving around the teeth and into contact with deeper interproximal areas, those of said free tip ends first coming into contact with rounded outward facing tooth surfaces apply less force against the teeth, avoiding detrimental tooth abrasion and notching.

2. The toothbrush of claim 1 wherein said bristles are made from soft materials.

3. The toothbrush of claim 1 wherein said common row is longitudinally extending on said brush head.

4. The toothbrush of claim 1 wherein said common row is centered laterally on said brush head.

5. A method for using said toothbrush of claim 1 to clean interproximal areas between adjacent tooth structures and tooth-gingival margins, each tooth structure having a long axis, said method comprising the steps of:

horizontally aligning said common row formed by said free tip ends of said bristles with at least one targeted interproximal area in need of cleaning;

applying pressure against said back portion of said head, holding said free tip ends of said bristles in perpendicular contact with the long axis of said tooth structures in said at least one targeted interproximal area; and using said handle to cause a quick vibratory motion of said bristles against said at least one targeted interproximal area to clean tooth structures and tooth-gingival margins therein.

6. The method of claim 5 wherein said steps of applying pressure and using said handle to cause a quick vibratory motion of said bristles are accomplished one-handed.

7. The method of claim 5 wherein said steps of applying pressure and using said handle to cause a quick vibratory motion of said bristles are accomplished two-handed.

8. The method of claim 5 wherein said at least one targeted interproximal area spans across more than two adjacent teeth.

9. The method of claim 5 further comprising a step of inwardly directing said bristles toward said tooth structures in a perpendicular orientation that moves said bristles straight against said tooth-gingival margins within said at least one targeted interproximal area and said step occurring before said step of applying pressure, and also comprising an additional step of maintaining said perpendicular orientation of said bristles relative to the tooth-gingival margin during said quick vibratory motion with said additional step occurring concurrently with said step of using said handle to cause a quick vibratory motion.

10. The method of claim 9 wherein said steps of applying pressure, using said handle to cause a quick vibratory motion, and maintaining said perpendicular orientation are accomplished one-handed.

11. The method of claim 9 wherein said steps of applying pressure, using said handle to cause a quick vibratory motion, and maintaining said perpendicular orientation are accomplished two-handed.

* * * * *